US005298002A

United States Patent [19]

Lin

[11] Patent Number: 5,298,002

[45] Date of Patent: Mar. 29, 1994

[54] STEPPER

[76] Inventor: Lan-Fa Lin, No. 20, Alley 28, Lane 37, Jen-Ho Rd., Tan-Tzu Hsiang, Taichung Hsien, Taiwan

[21] Appl. No.: 89,804

[22] Filed: Jul. 9, 1993

[51] Int. Cl.[5] ..... A63B 22/04

[52] U.S. Cl. ..... 482/53; 482/79

[58] Field of Search ..... 482/51, 52, 53, 79, 482/80, 148, 111, 112

[56] References Cited

U.S. PATENT DOCUMENTS

| | | | |
|---|---|---|---|
| 3,747,924 | 7/1973 | Champoux | 482/53 |
| 5,199,934 | 4/1993 | Lin | 482/52 |
| 5,230,675 | 7/1993 | Lin | 482/53 |
| 5,232,421 | 8/1993 | Chen et al. | 482/53 |

*Primary Examiner*—Stephen R. Crow
*Attorney, Agent, or Firm*—Christensen, O'Connor, Johnson & Kindness

[57] ABSTRACT

A stepper includes a base frame, a parallel-crank linkage, and a resistance device. The base frame has a pivot portion located at an intermediate section thereof. The parallel-crank linkage includes a pedal assembly, a reciprocating lever and two parallel cranks. The pedal assembly has two horizontal pedals, each of which having an inverted U-shaped bracket secured to a bottom surface thereof. The reciprocating lever has a middle section mounted pivotally on an upper section of the pivot portion of the base frame and two end sections mounted pivotally and respectively on the inverted U-shaped brackets of the pedal assembly. The cranks are disposed under the reciprocating lever. One of the cranks is pivotally connected to the pivot portion of the base frame at one end thereof and to one of the inverted U-shaped brackets of the pedal assembly at the other end. The other one of the cranks is pivotally connected to the pivot portion of the base frame at one end thereof and to the other one of the inverted U-shaped brackets of the pedal assembly at the other end. The resistance device is interposed between the reciprocating lever and the base frame and is adapted to provide a resistance to pivotal movement of the reciprocating lever.

4 Claims, 10 Drawing Sheets

STEPPER

BACKGROUND OF THE INVENTION

1. Field of the Invention

This invention relates to a stepper, more particularly to a stepper which has a parallel-crank linkage that is capable of maintaining the pedals of the stepper in a horizontal state when the stepper is in use so as to enhance the safety features of the stepper.

2. Description of the Related Art

Referring to FIG. 1, a conventional stepper includes a support frame 1 having an upwardly extending front section 11, a pair of parallel foot beams 2 having end portions pivotally connected to a lower end portion of the front section 11 of the support frame I, and a pair of hydraulic cylinders 3. Each of the hydraulic cylinders 3 interconnects an intermediate portion of one of the foot beams 2 and an intermediate portion of the front section 11 of the support frame 1. A rope 4 has two ends respectively and fixedly connected to the intermediate portions of the foot beams 2 and extends over a pulley 12. The pulley 12 is mounted on the intermediate portion of the front section 11 of the support frame I above the foot beams 2 The front section 11 of the support frame 1 has a handgrip member 5 mounted securely on an upper end portion thereof. Referring to FIG. 2, the drawback of this stepper is that, when in operation, the user easily topples over because the foot beams 2 are inclined. As a result, stepping on the foot beams 2 may be dangerous.

SUMMARY OF THE INVENTION

The main objective of this invention is to provide a stepper which has a parallel-crank linkage that is capable of maintaining the pedals of the stepper in a horizontal state when the stepper in use so as to enhance the safety features of the stepper.

According to this invention, a stepper includes a base frame, a parallel-crank linkage, and a resistance device. The base frame has a pivot portion located at an intermediate section thereof.

The parallel-crank linkage includes a pedal assembly, a reciprocating lever and two parallel cranks. The pedal assembly has two horizontal pedals, each of which having an inverted U-shaped bracket secured to a bottom surface thereof. The reciprocating lever has a middle section mounted pivotally on an upper section of the pivot portion of the base frame and two end sections mounted pivotally and respectively on the inverted U-shaped brackets of the pedal assembly. The cranks are disposed under the reciprocating lever. One of the cranks is connected pivotally to the pivot portion of the base frame at one end thereof and to one of the inverted U-shaped brackets of the pedal assembly at the other end. The other one of the cranks is connected pivotally to the pivot portion of the base frame at one end thereof and to the other one of the inverted U-shaped brackets of the pedal assembly at the other end.

The resistance device is interposed between the reciprocating lever and the base frame and is adapted to provide a resistance to pivotal movement of the reciprocating lever.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
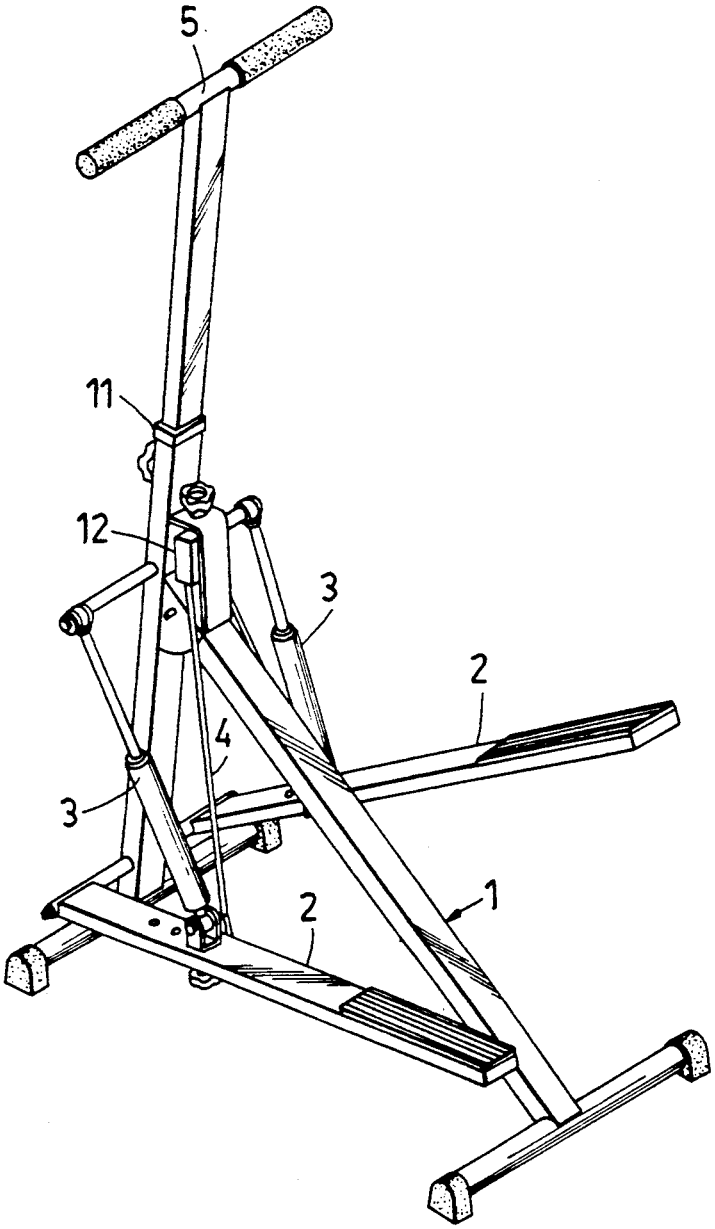
FIG.1 PRIOR ART
FIG. 1 is a perspective view of a conventional stepper.
Figure 2:
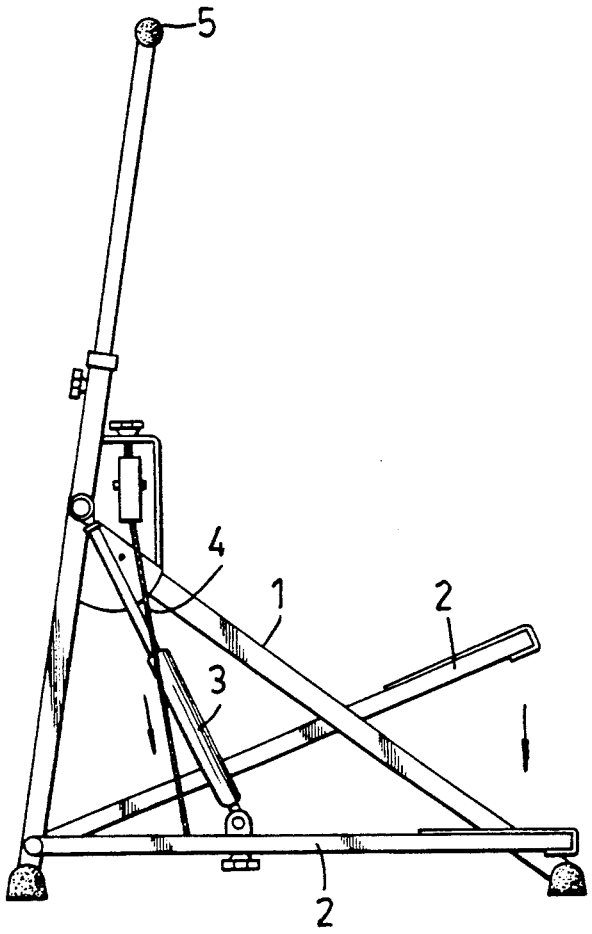
FIG.2 PRIOR ART
FIG. 2 is a schematic view illustrating the operation of the conventional stepper.
Figure 3:
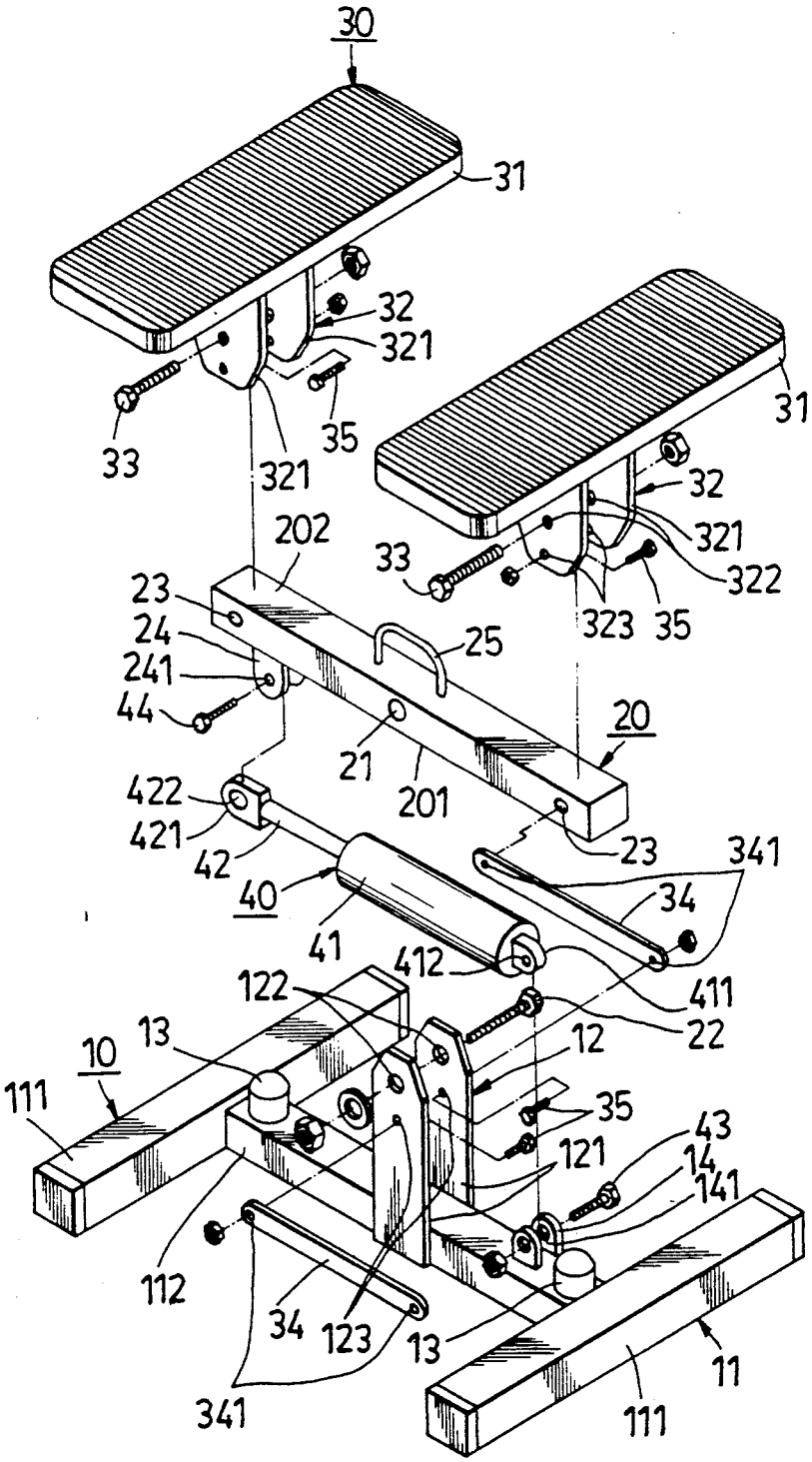
FIG. 3 is an exploded view showing a stepper of the first preferred embodiment according to this invention.
Figure 4:
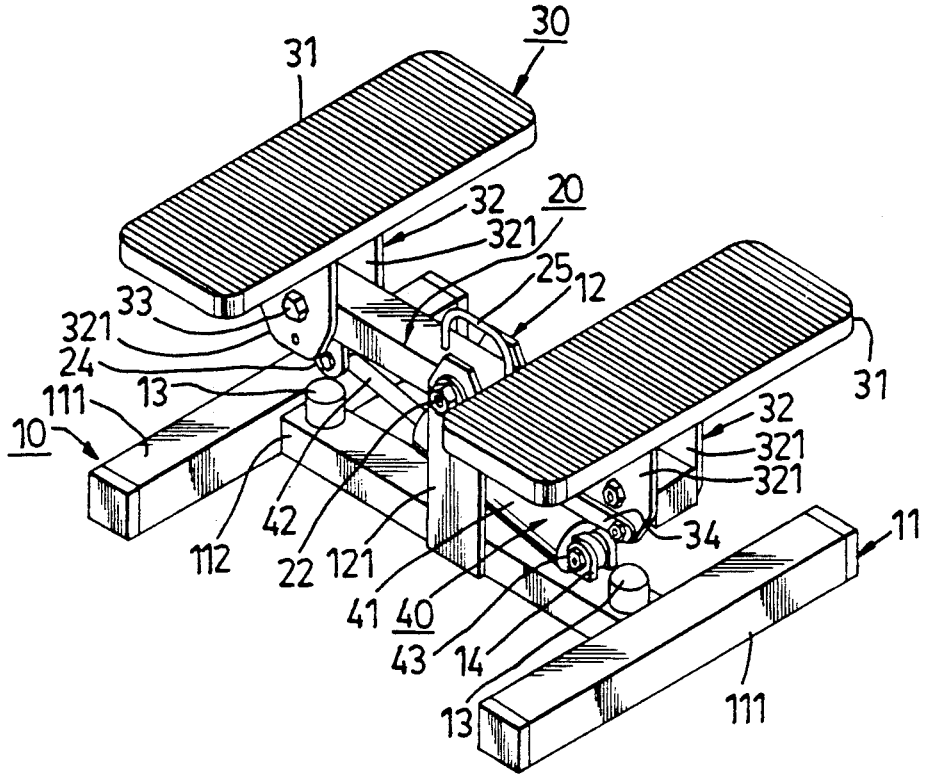
FIG. 4 is a perspective view showing the stepper in accordance with the first preferred embodiment of this invention.

Referring to FIGS. 3 and 4, the stepper of the first preferred embodiment of this invention includes a base frame 10, a reciprocating lever 20, a pedal assembly 30, and a hydraulic cylinder 40 that is used as a resistance device.

The base frame 10 includes a generally H-shaped body 11 and a pivot portion 12. The H-shaped body 11 includes a longitudinally extending central beam 112 and a pair of transverse beams 111 respectively and securely connected to two ends of the central beam 112 at the middle sections thereof. The pivot portion 12 includes two parallel plates 121 with lower end sections respectively and securely mounted on two side walls of the middle section of the central beam 112. Each of the parallel plates 121 has a large pivot hole 122 formed in an upper end section thereof and a small pivot hole 123 formed at a location under the large pivot hole 122. The large pivot holes 122 are aligned with each other. Two cushion members 13 are respectively and securely mounted on two end sections of the top surface of the central beam 112 A pair of parallel pivot plates 14 are fixedly mounted on one of the end sections of the top surface of the central beam 112 and have two aligned pivot holes 141 respectively formed therein.

The reciprocating lever 20 includes an elongated rectangular body which has two end pivot holes 23 and a middle pivot hole 21 formed therethrough. The reciprocating lever 20 is pivotally mounted on the pivot portion 12 of the base frame 10 by means of a pivot pin 22 that extends through the large pivot holes 122 of the pivot portion 12 of the base frame 10 and the middle pivot hole 21 of the reciprocating lever 20. An inverted U-shaped bracket 24 is securely mounted on the bottom surface 201 of one of the end sections of the reciprocating lever 20 and is formed with two aligned pivot holes 241. A handle 25 is securely mounted on the top surface 202 of the intermediate section of the reciprocation lever 20 so as to facilitate handling of the stepper.

The pedal assembly 30 includes two horizontal pedals 31, each of which having an inverted U-shaped bracket 32 securely connected to a bottom surface thereof. Each of the inverted U-shaped brackets 32 of the pedal assembly 30 has two aligned small pivot holes 323 formed at a lower section thereof and two aligned large pivot holes 322 formed at a location above the aligned small pivot holes 323. The pedals 31 are respectively and pivotally mounted on two end sections of the reciprocating lever 20 by means of pivot pins 33 that extend through the aligned large pivot holes 322 of one of the inverted U-shaped brackets 32 and one of the corresponding end pivot holes 23 of the reciprocating lever 20. Two parallel cranks 34 are disposed under the reciprocating lever 20. Each of the cranks 34 has a first end pivotally connected to the parallel plates 121 of the pivot portion 12 of the base frame 10 and a second end pivotally connected to the inverted U-shaped brackets 32 of the pedal assembly 30. Each of the parallel cranks 34 further has two end holes 341 respectively aligned with one of the small pivot hole 123 of the pivot portion 12 and one of the aligned small pivot holes 323 of the corresponding inverted U-shaped bracket 32 so as to allow pivot pins 35 to extend therethrough, thereby constituting a parallel-crank linkage.

The hydraulic cylinder 40 has a cylinder body 41 and a piston rod 42. The cylinder body 41 has a pivot end 411 pivotally mounted on the parallel pivot plates 14 by a pivot pin 43 that extends through the pivot holes 141 of the parallel pivot plates 14 and the pivot hole 412 of the pivot end 411. The piston rod 42 extends from the cylinder body 41 and has a pivot end 421 pivotally mounted on the inverted U-shaped bracket 24 by a pivot pin 44 that extends through the pivot holes 241 of the inverted U-shaped bracket 24 and the pivot hole 422 of the pivot end 421 of the piston rod 42. Accordingly, the hydraulic cylinder 40 interconnects the reciprocating lever 20 and the base frame 10, thereby providing a resistance to pivotal movement of the reciprocating lever 20.

Figure 5:
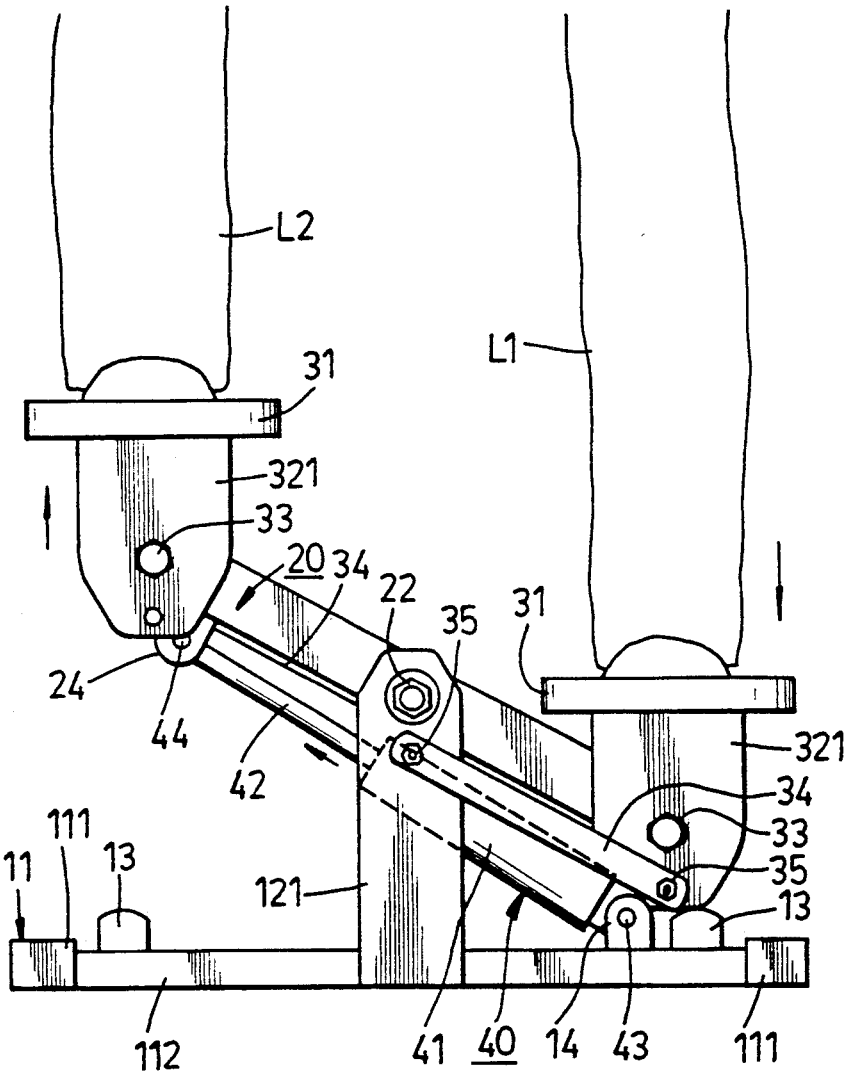
FIG. 5 is a schematic view illustrating the first operating method of the first preferred embodiment according to this invention.

Referring to FIG. 5, when operating the stepper of the first preferred embodiment of this invention, the user depresses the right pedal 31 until the right bottom side of the reciprocating lever 20 rests on one of the cushion members 13. When the depressing force is shifted from the right foot (L1) to the left foot (L2), the reciprocating lever 20 pivots until the left bottom side of the reciprocating lever 20 rests on the other one of the cushion members 13. The pedal assembly 30 is pivotally mounted on the reciprocating lever 20 and the parallel cranks 34 so as to form the parallel-crank linkage. The parallel-crank linkage enables the pedals 31 to be maintained in a horizontal state when the stepper is in use. Accordingly, the user can stand steadily on the pedals 31 when operating the stepper of this invention. The present invention is thus safer to use than the prior art.

Figure 6:
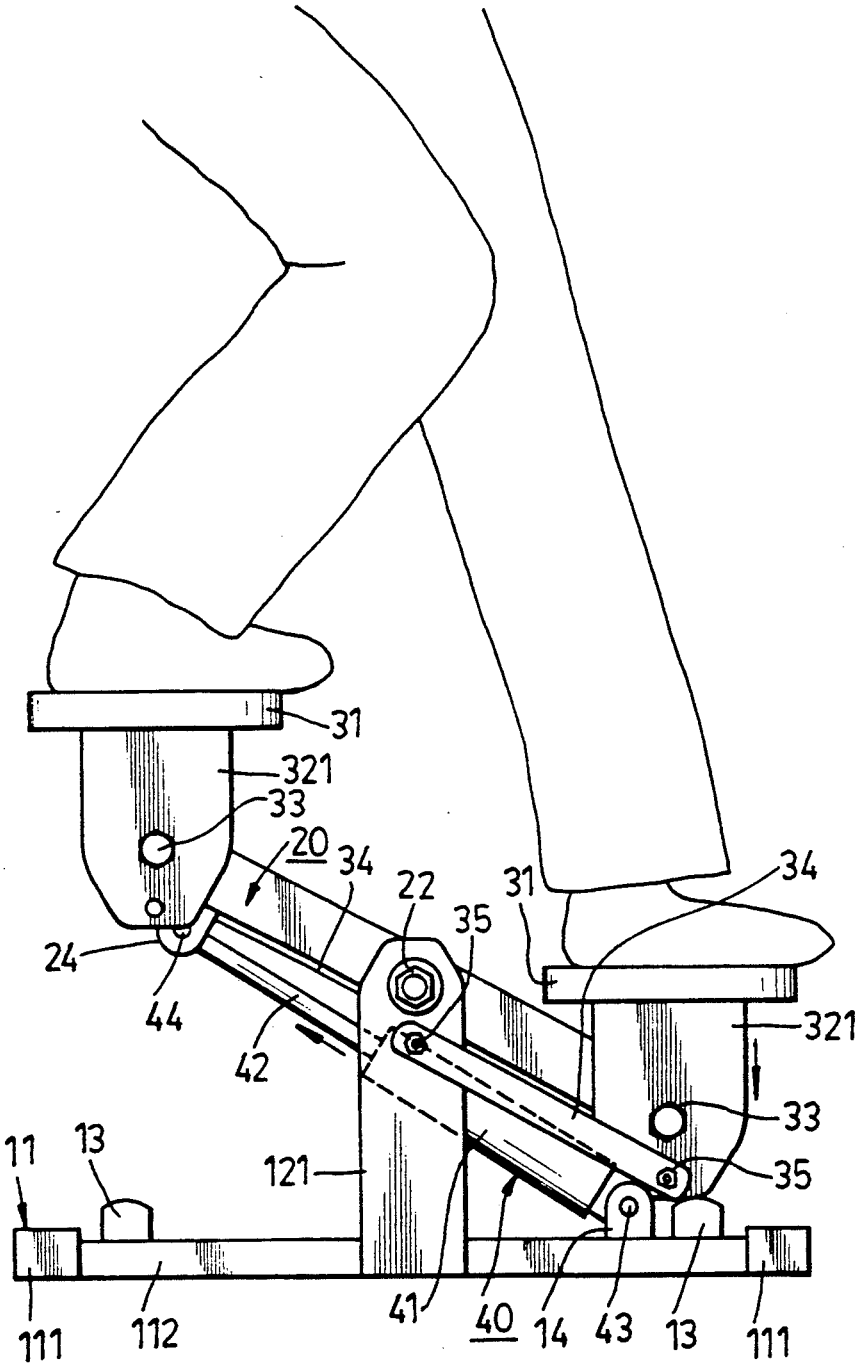
FIG. 6 is a schematic view illustrating the second operating method of the first preferred embodiment in accordance with this invention.

Referring to FIG. 6, the user may stand on the pedals 31 in such a manner that his or her feet are positioned sideways in order to operate the first preferred embodiment in a marching manner.

Figure 7:
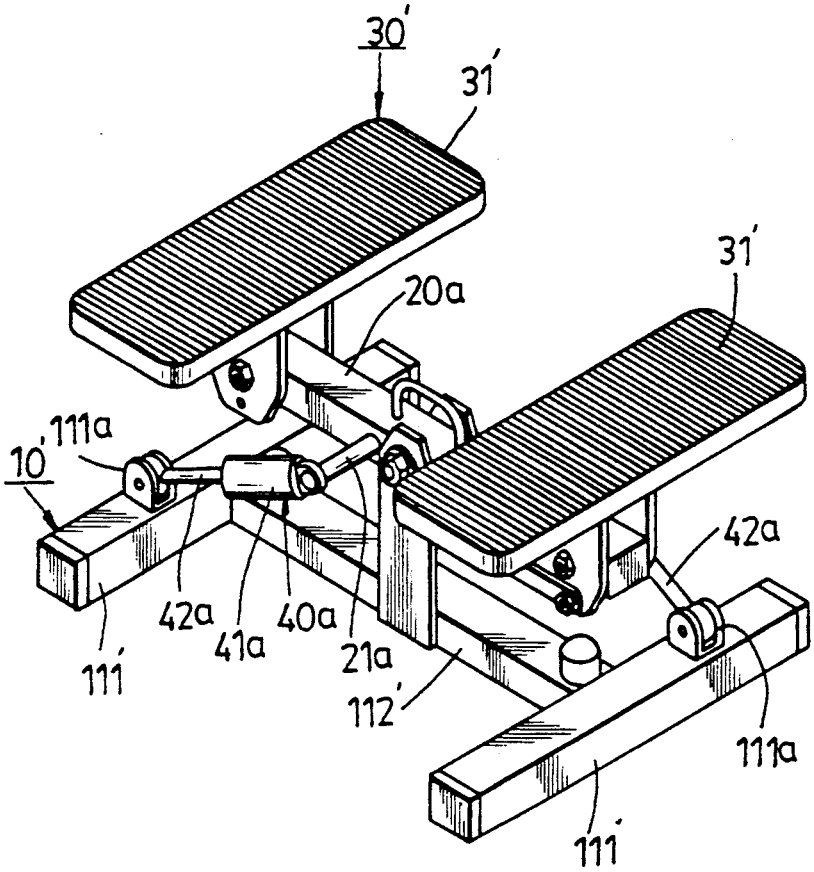
FIG. 7 is a perspective view of the second preferred embodiment of the stepper in accordance with this invention.
Figure 8:
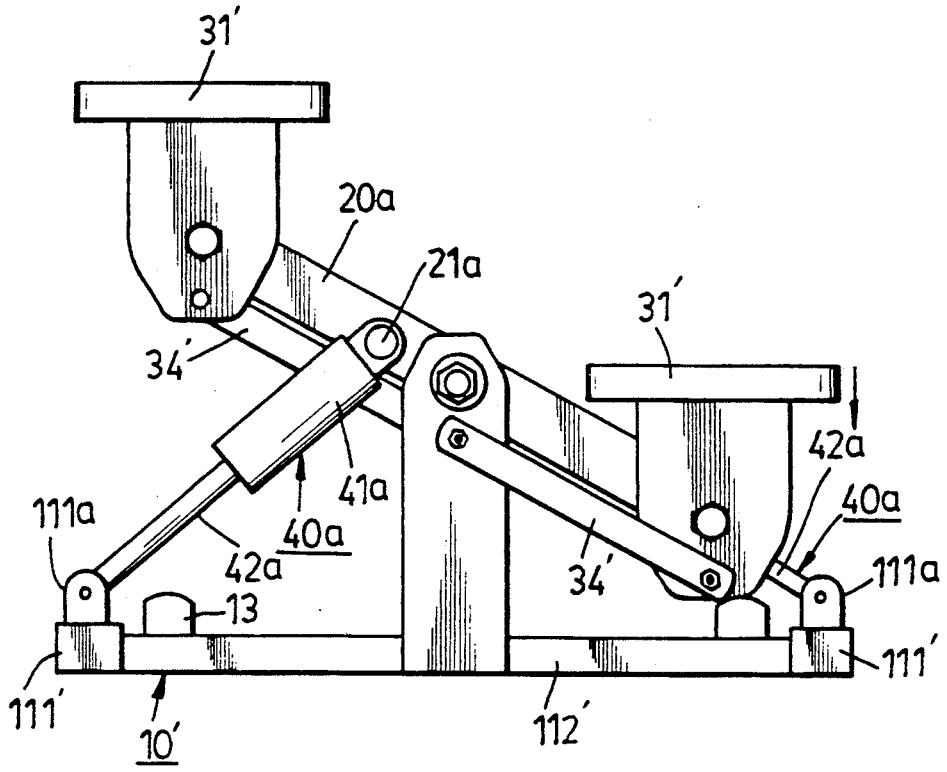
FIG. 8 is a schematic view illustrating the operation of the stepper according to the second preferred embodiment of this invention.

Referring to FIGS. 7 and 8, the stepper of the second preferred embodiment of this invention includes a base frame 10', a reciprocating lever 20*a*, a pedal assembly 30', and a pair of hydraulic cylinders 40*a* that are used as a resistance device. The reciprocating lever 20*a* interconnects the base frame 10' and the pedal assembly 30' in a manner similar to that in the first embodiment. The pedal assembly 30' is similar in construction to that of the first embodiment. Two parallel cranks 34' are disposed under the reciprocating lever 20*a* and pivotally interconnect the base frame 10' and the pedal assembly 30' so as to provide the same parallel-crank linkage as that of the first embodiment. The reciprocating lever 20*a* has two pivot rods 21*a* (only one is shown) respectively extending from two sides of the middle section of the reciprocating lever 20*a* in opposite directions. The base frame 10' has a generally H-shaped body that includes a longitudinally extending central beam 112' and two transverse beams 111' respectively secured to two ends of the central beam 112'. Two U-shaped brackets 111*a* are respectively and securely mounted on the transverse beams 111' near the intermediate sections of the latter. Each of the hydraulic cylinders 40*a* has a cylinder body 41*a* that is pivotally connected to one of the pivot rods 21*a* of the reciprocating lever 20*a*, and a piston rod 42*a* that extends from the cylinder body 41*a* and that is positioned in one of the U-shaped brackets 111*a* so that the hydraulic cylinders 40*a* can provide a resistance to pivotal movement of the reciprocating lever 20*a*.

Figure 9:
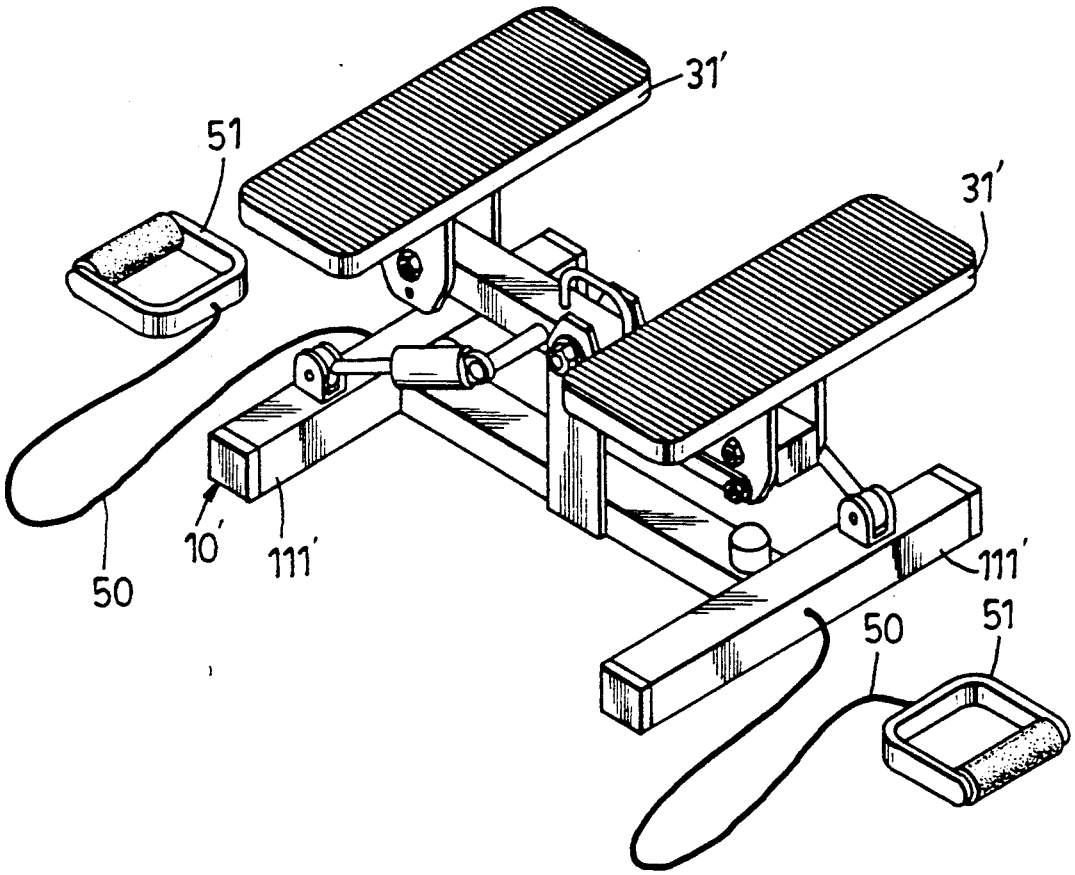
FIG. 9 is a perspective view showing the third preferred embodiment of the stepper according to this invention.

Referring to FIG. 9, the stepper of the second preferred embodiment of this invention may be provided with two elastic ropes 50 which are respectively disposed on the transverse beams 111' of the base frame 10'. Each of the ropes 50 has a first end portion securely connected to the outside wall of the intermediate section of one of the transverse beams 111' of the base frame 10', and a second end portion with a handle 51 fastened thereto. Accordingly, while stepping on the pedals 31', the user can pull the ropes 50 so as to exercise the muscles of the arms simultaneously.

Figure 10:
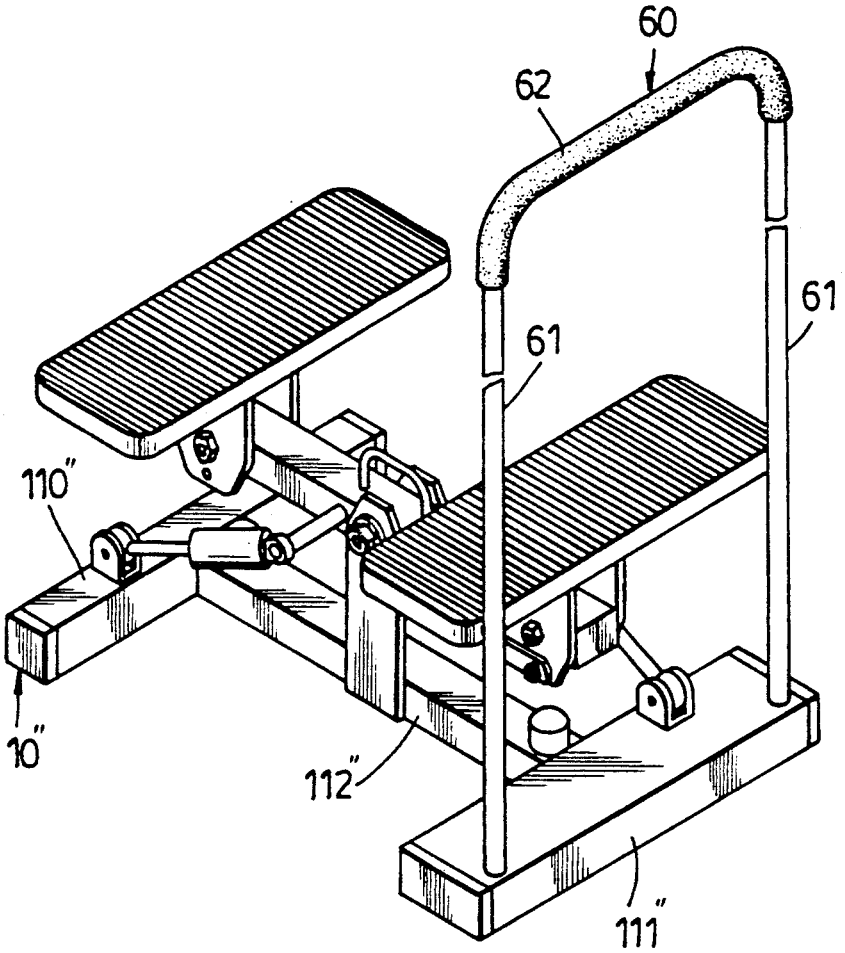
FIG. 10 is a perspective view showing the fourth preferred embodiment of the stepper in accordance with this invention.

Referring to FIG. 10, the stepper of the fourth preferred embodiment of this invention has a modified base frame 10". The base frame 10" has a longitudinally extending central beam 112", a narrow transverse beam 110" connected securely to one of the ends of the central beam 112" at an intermediate section thereof, and a wide transverse beam connected securely to the other end of the central beam 112" at an intermediate section thereof. The wide transverse beam 111" has an inverted U-shaped handle unit 60 which includes two parallel upright bars 61 with lower ends securely mounted on the wide transverse beam 111" and a handle bar 62 interconnecting the upper ends of the upright bars 61. The user can grip the handle bar 62 when the stepper in use, thereby permitting safe operation of the latter.

With this invention thus explained, it is apparent that numerous modifications and variations can be made without departing from the scope and spirit of this invention. It is therefore intended that this invention be limited only as indicated in the appended claims.

I claim:

1. A stepper, comprising:

a base frame having a pivot portion located at an intermediate section thereof;

a parallel-crank linkage including: a pedal assembly having two horizontal pedals, each of which having an inverted U-shaped bracket secured to a bottom surface thereof; a reciprocating lever having a middle section mounted pivotally on an upper section of said pivot portion of said base frame and two end sections mounted pivotally and respectively on said inverted U-shaped brackets, of said pedal assembly; and two parallel cranks disposed under said reciprocating lever, one of said cranks pivotally interconnecting said pivot portion of said base frame and one of said inverted U-shaped brackets of said pedal assembly, the other one of said cranks pivotally interconnecting said pivot portion of said base frame and the other one of said inverted U-shaped brackets of said pedal assembly; and a resistance device interposed between said reciprocating lever and said base frame and adapted to provide a resistance to pivotal movement of said reciprocating lever.

2. A stepper as claimed in claim 1, wherein said resistance device includes a hydraulic cylinder having a cylinder body pivotally connected to an end section of said central beam of said base frame and a piston rod extending from said cylinder body and being pivotally connected to said bottom side of a corresponding end section of said reciprocating lever.

3. A stepper as claimed in claim 1, wherein said resistance device includes a pair of hydraulic cylinders, each of which having a cylinder body pivotally connected to said reciprocating lever near said middle section of said reciprocating lever, and a piston rod extending from said hydraulic cylinder, said piston rods of said hydraulic cylinders being respectively and pivotally connected to two opposite sides of said base frame.

4. A stepper as claimed in claim 1, wherein said stepper further includes two elastic ropes which are disposed on two opposite sides of said base frame, each of said ropes having a first end portion secured to said base frame and a second end portion with a handle fastened thereto, whereby, while stepping on the pedals, a user can pull the ropes so as to exercise muscles of arms simultaneously.

* * * * *